US005103695A

United States Patent [19]

Dolle et al.

[11] Patent Number: 5,103,695

[45] Date of Patent: Apr. 14, 1992

[54] LIGHT BULB EXTRACTOR

[76] Inventors: Alvin J. Dolle, 1005 Spent Wing, San Antonio, Tex. 78213; Warren G. Alston, HC56 Box 1594, Bulverde, Tex. 78163

[21] Appl. No.: 591,802

[22] Filed: Oct. 2, 1990

[51] Int. Cl.[5] ..... H01K 3/32

[52] U.S. Cl. ..... 81/53.11; 81/64; 81/3.4; 81/124.4; 81/177.4

[58] Field of Search ..... 81/53.1, 53.11, 53.12, 81/64, DIG. 11, 124.4, 120, 177.4, 585, 490, 3.4; 294/19.2, 24

[56] References Cited

U.S. PATENT DOCUMENTS 2,117,017 5/1938 Chadsey ..... 81/53.11
3,284,123 11/1966 Adams ..... 81/53.11 X
4,314,723 2/1982 Vermillion ..... 81/53.11

*Primary Examiner*—D. S. Meislin
*Attorney, Agent, or Firm*—Gunn, Lee & Miller

[57] ABSTRACT

An assembly of tools for the removal, handling, and replacement of light bulbs and light bulb bases from their mounting sockets. The assembly is made up of three components which each have two ends that function to either surround and grip a light bulb and insert or remove it from its socket, or to contact and grip a broken base of a light bulb so as to remove it from its socket. The three components of the assembly are configured so as to nest one within another and to be retained therein in a compact assemblage. The components are made of a durable elastic material that may deform to grip a bulb or a bulb base, and subsequently return to their original shape.

3 Claims, 1 Drawing Sheet

LIGHT BULB EXTRACTOR

BACKGROUND OF THE INVENTION

1. Field of the Invention

The present invention relates generally to tools for removing and handling light bulbs and light bulb components. More specifically, the present invention relates to an extractor for removing light bulbs or light bulb bases where the bulb might be broken, unbroken, or corroded in a socket.

2. Description of Related Art

The utilization of light bulbs powered by electric current, long ago became a necessity of every day life. Light bulbs today are used in every imaginable environment, and for every conceivable application. Despite this diversity of utilization, there are a few generalities that can be stated about the nature and use of light bulbs in today's technological world.

Light bulbs can be generically described as devices which incorporate electrical current carrying means inside of enclosures which inhibit the presence of a reactive atmosphere, and at the same time allow the passage of light given off by the resistant current carrying means. Most light bulbs, therefore, are made up of a glass bulb which encloses a metallic and/or gaseous filament and a metallic base which contains contacts electrically connected to the filament.

Because filaments are seldom indestructible, and because most light bulbs have finite life times, it is inevitably necessary to replace them for most applications. The utilization of a light bulb, therefore, anticipates this necessity, and more often than not, light bulbs are provided with sockets that facilitate an easy removal and insertion. Such sockets generally conform to the structure of the metallic base of the light bulb, and contain contacts designed to electrically conduct current through the base to the filament.

The removal and replacement of a light bulb from its socket can be complicated by a great number of factors. Light bulbs which burn regularly can reach extremely high temperatures, and when circumstances demand the removal of a bulb that is at such a high temperature or is slowly cooling down from a high temperature, the risk of being burned becomes significant.

Light bulbs are often located in environments that provide little access for the removal and replacement of the bulb. The problems associated with either gripping the bulb or gripping the bulb with sufficient force to allow its removal, can often complicate what would otherwise be a simple operation.

Light bulbs can be delicate objects, because of the component parts that are made of glass. A frequent reason for the necessity of light bulb replacement is simply the breakage of the glass bulb. The removal of the bulb base and of what remains of the broken bulb poses a significant risk of electric shock from an exposed filament and/or of being cut on the exposed glass edges. Even apart from the replacement of broken bulbs, the risk of shock is present where the replacement of unbroken bulbs can result in exposure of the metal base contacts, which may continue to carry current during the replacement process.

All of the above situations may be complicated even further by the corrosion of a light bulb's base within its socket. Any time current is allowed to flow through metal electrical contacts, the tendency for the metal and/or elements in the air to oxidize on the metallic surfaces is increased. It is not unusual, therefore, to find that such light bulb sockets and bases can become quickly and heavily corroded in a manner that may prevent or make more difficult the removal of the bulb from the socket.

Efforts in the past to provide adequate tools for the removal of light bulbs and light bulb components from their sockets have not been generally satisfactory. Very often, a means for removing a bulb is not an appropriate means for removing a bulb's base and vice versa. Frequently, a means for removing a specific light bulb is not appropriate for bulbs that deviate even slightly from a standard configuration. Frequently, where a removal tool might serve to remove a bulb in one environment, it may be wholly inadequate in another environment. For example, where pliers might be appropriate for the removal of a broken bulb when the bulb socket is not energized, it would be wholly inappropriate when the situation makes it impractical to shut off the current to the bulb's socket.

The result has been that any individual faced with the necessity of frequently removing broken and unbroken and/or corroded bulbs from their sockets, has been required to carry a large quantity and variety of tools in order to anticipate every potential problem. It would be advantageous for such an individual to have at his disposal a compact, versatile, generally applicable means for the removal, replacement, and handling of not only unbroken, but broken and corroded bulbs and their bases.

SUMMARY OF THE INVENTION

Accordingly, one object of the present invention is to provide an assembly of tools for removing light bulbs from their mounting sockets.

Another object of the present invention is to provide an assembly of tools for removing light bulbs from their mounting sockets where the bulbs' stems are corroded.

Another object of the present invention is to provide an assembly of tools for removing light bulbs from their mounting sockets where access is restricted.

Another object of the present invention is to provide an assembly of tools for removing light bulbs from their sockets where the glass components of the bulbs are broken.

In fulfillment of these and other objectives, the present invention provides an assembly of tools designed to either encompass and grip, or contact and grip, a broken or unbroken bulb, and aid in its removal from a socket. The present invention utilizes extraction tools of various sizes, which are configured to appropriately encompass and/or contact standard size bulbs and their bases. The variety of tools are made of a resilient rubber or synthetic rubber material that provides a durable, flexible surface with a high frictional resistance. The tools are configured with substantially cylindrical cups and/or substantially cylindrical stubs of a variety of diameters. The various tools are of sizes and shapes that they might be nested one in another to form a compact assembly.

Other objects and advantages of the present invention will become apparent from the following detailed description and drawing.

DETAILED DESCRIPTION OF A PREFERRED EMBODIMENT

Figure 1:
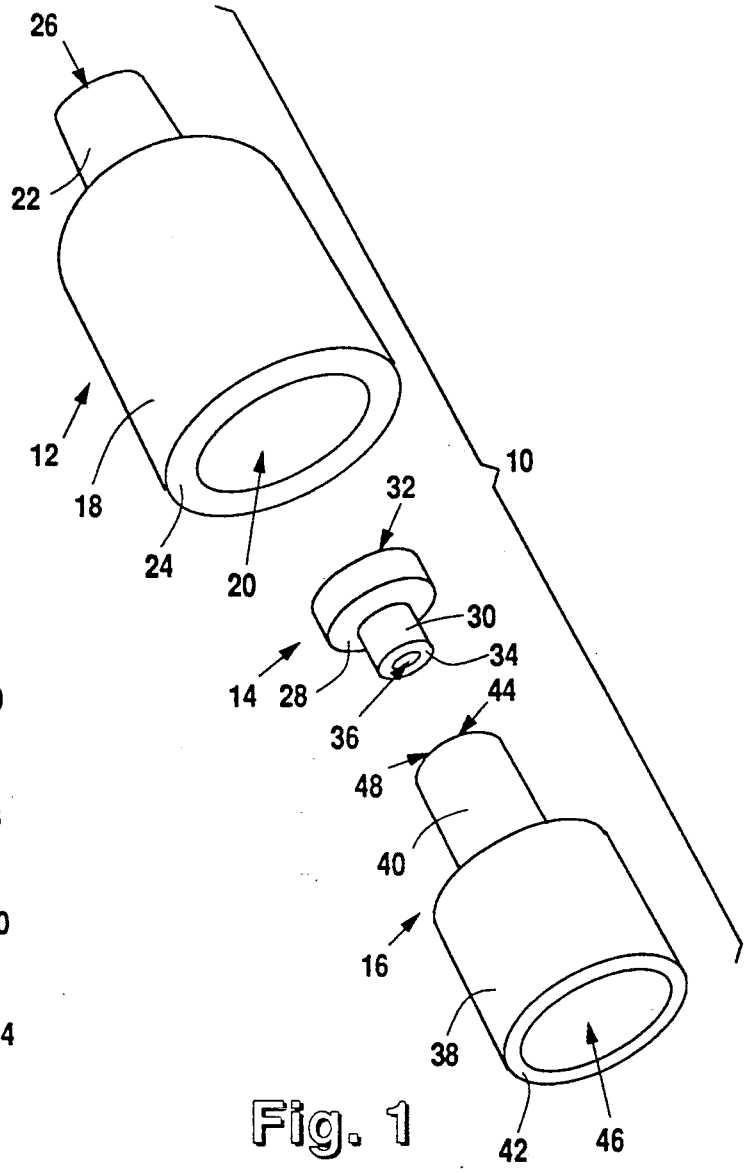
FIG. 1 is an exploded perspective view of a preferred embodiment of the present invention showing the three primary components of the embodiment.

Reference is made first to FIG. 1, which is an exploded perspective view of a preferred embodiment of the present invention that discloses each of the three primary components of the invention in an unassembled state. Tool assembly 10 is comprised of large tool 12, small tool 14, and medium tool 16. Component tools 12, 14 and 16 are shown in FIG. 1 as they might be aligned prior to the nesting of each one into another.

Large tool 12 comprises two primary functional parts. Disposed at one end of large tool 12 is large cup 18, and at an opposite end of large tool 12 is large stub 22. Large cup 18 is a substantially cylindrical cup closed at one end and open at a second end so as to form large cup cavity 20. In the preferred embodiment, large cup 18 has a slightly larger diameter at the opening of large cup cavity 20 than at an opposite interior end. Large cup cavity 20 terminates at its open end with large cup face 24.

Large stub 22 positioned coaxially with large cup 18 at an end of large tool 12 opposite large cup 18, is a substantially cylindrical structure with large stub face 26 defining a closed end thereof, and an interior cavity (not shown) which opens into large cup cavity 20. Large stub 22, therefore, presents substantially flat large stub face 26 in a direction opposite the opening of large cup cavity 20.

Small tool 14 likewise has two primary functional parts. Small base 28 is disposed at a first end of small tool 14 and small cup 30 is disposed at an opposite end of small tool 14. Small base 28 is a substantially cylindrical solid, which presents small base face 32 in a direction opposite that of small cup 30. Small cup 30 is a substantially cylindrical cup, which presents an open end at small cup face 34 and a closed end (not shown) adjacent to small base 28. Small cup 30 defines small cup cavity 36, and presents small cup face 34 in a direction opposite that of small base face 32.

Medium tool 16 also comprises two primary functional parts Medium tool 16 is made up of first medium cup 38 disposed at a first end, and second medium cup 40 disposed at an opposite end. First medium cup 38 is a substantially cylindrical cup having an open end defined by first medium cup face 42, and directed opposite of second medium cup 40. First medium cup 38 is partially closed at an interior end (not shown) where it is adjacent to second medium cup 40. Second medium cup 40 is also a substantially cylindrical cup with an open end opposite that of first medium cup 38. The open end of second medium cup 40 is defined by second medium cup face 44. First medium cup 38 defines first medium cup cavity 46. Second medium cup 40 defines second medium cup cavity 48. First medium cup 38 has a diameter at its open end that is slightly larger than a diameter at an opposite end adjacent second medium cup 40. Second medium cup 40 has a substantially consistent diameter throughout its length.

Figure 2:
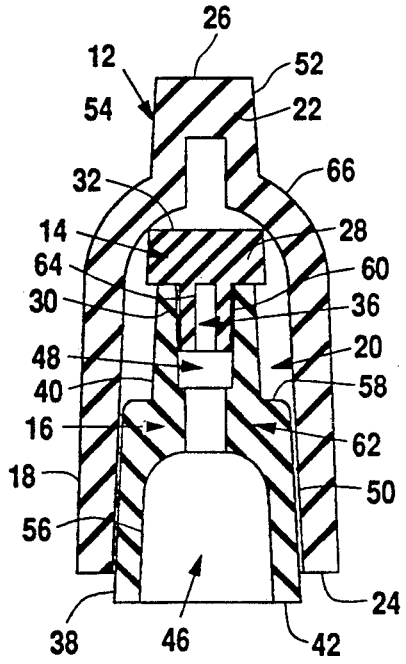
FIG. 2 is a cross sectional view of a preferred embodiment of the present invention taken along line a—a of FIG. 3.

Reference is now made to FIG. 2 for a cross sectional view of a preferred embodiment of the present invention showing the three primary components of tool assembly 10 in a nested configuration. Large tool 12, small tool 14, and medium tool 16 are nested together such that each component is coaxially positioned.

In this configuration, small cup 30 of small tool 14 is inserted into second medium cup cavity 48 of medium tool 16. Small cup 30 extends into second medium cup cavity 48 to a point at which small base 28 contacts second medium cup face 44.

This two-component assembly of small tool 12 and medium tool 14 is then placed into large cup cavity 20 of large tool 12. This achieves the configuration disclosed in FIG. 2, wherein small tool 14 is nested interior to and between medium tool 16 and large tool 12.

The contact between each of tools 12, 14, and 16 is such that approximate similarities in diameters and dimensions creates a fit which allows the components to be appropriately retained and yet easily removed one from another.

More clearly visible in FIG. 2 are additional features of large tool 12, small tool 14, and medium tool 16. Large tool 12 can be seen not only to define large cup cavity 20, but also to define an extension thereof shown as large stub cavity 54. Large cup 18 is integrally attached to large stub 22 with the transition of one to the other being defined by large tool shoulder 66. Large cup cavity 20 has large cavity wall 50, which terminates at a closed end of large cup cavity 20 in a partially spherical configuration. Large stub 22 has a substantially cylindrical exterior large stub surface 52, which as described below, amounts to a secondary functional feature of large tool 12.

Medium tool 16 can be seen in cross section to be comprised of first medium cup 38 and second medium cup 40, which define, respectively, first medium cup cavity 46, and second medium cup cavity 48. First medium cup cavity 46 has first medium cavity wall 56 as its interior, and second medium cup cavity 48 has second medium cavity wall 60 as its interior. First medium cup cavity 46, and second medium cup cavity 48 are connected through a center of medium tool 16 by way of medium cup connector 62. Second medium cup 40 is of a slightly smaller diameter than first medium cup 38, which results in a transition on the exterior of medium tool 16 defined by medium tool shoulder 58. Medium cup connector 62 is a substantially cylindrical conduit connecting the otherwise closed ends of first medium cup cavity 46, and second medium cup cavity 48.

Small tool 14 can be seen in cross section to contain solid small base 28, and small cup 30. Small cup 30 can be seen to define small cup cavity 36, which terminates at a closed end adjacent to small base 28, and opens at an opposite end at small cup face 34. Small cup cavity 36 has as its interior, small cavity wall 64. Small cup 30 is a substantially cylindrical cup with a substantially consistent diameter.

Figure 3:
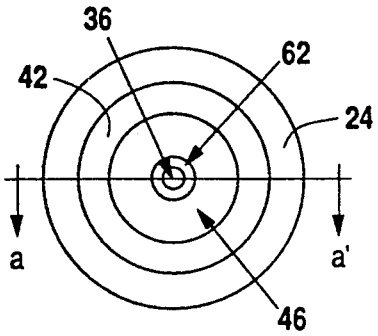
FIG. 3 is a bottom view of a preferred embodiment of the present invention showing the three primary components of the embodiment as they are nested in FIG. 2.

Reference is now made to FIG. 3 for a bottom view of the assembly shown in FIG. 2, wherein the primary components of tool assembly 10 are disclosed nested one within another. The concentric rings disclosed in FIG. 3 indicate the relative positions of the various components held within the nested configuration. The first outer ring disclosed in FIG. 3 is large cup face 24 of large tool 12. The next ring in, adjacent to large cup face 24, is first medium cup face 42. The next ring in from first medium cup face 42 is best described as the empty space defined by first medium cup cavity 46 (actually presented is first medium cavity wall 56 which defines first medium cup cavity 46). The next ring inward from first medium cup cavity 46 is best described as the empty space defined by medium cup connector 62 (actually presented is small cup face 34 viewed through medium cup connector 62). Finally, the central area disclosed in FIG. 3 is best described the empty space defined by small cup cavity 36 in its position nested atop medium tool 16 (actually presented is the closed end of small cup 30 created by small base 28).

There are at least ten primary functional features represented by tool assembly 10 in this preferred embodiment. There are additionally a number of secondary functional features, which are also made possible by the structures of the elements of tool assembly 10. The various functional features of tool assembly 10 are intended to accomplish either the act of surrounding and gripping a light bulb, primarily by way of the glass structure of the bulb, or contacting and gripping some part of the base structure of a broken bulb assembly. It is additionally possible to use the functional features of tool assembly 10 to surround and grip the filament stem of a broken light bulb assembly.

Large tool 12 and small tool 14 each have three primary functional features and a number of secondary functional features. Large tool 12 has three primary functional features, which are defined by large cup cavity 20, large cup face 24, and large stub face 26. Large cup cavity 20 serves to surround and grip an unbroken or slightly broken glass component of an appropriately sized light bulb. Large cup face 24 serves to contact and grip the base of a broken light bulb about its perimeter. Large stub face 26 is likewise designed to contact and grip the base of a broken light bulb assembly.

Secondary functional features of large tool 12 are defined by the interior and exterior surfaces of its structural components. Large stub surface 52 for example, can serve itself to grip the interior of the walls of the base of a broken light bulb assembly. This would occur where the diameter of the base of a light bulb assembly is somewhat larger than the diameter defined by large stub face 26. In this manner, large stub 22 may be partially inserted into the base of a broken light bulb assembly causing large stub surface 52 to contact, and grip the base for removal. In a related application where all of large stub 22 will fit within the base of a broken off light bulb assembly, large tool shoulder 66 may serve to contact the peripheral edge of the base member of the broken bulb assembly.

A final secondary functional feature of large tool 12 is defined by large stub cavity 54. In some situations, filament bulbs position their filaments inside the glass bulb by way of a glass or ceramic pedestal. This glass or ceramic pedestal extends upwardly away from the bulb's base, and often remains unbroken even when the glass globe of the light bulb is broken. Large stub cavity 54 is appropriately positioned and sized to receive and grip such filament pedestals in broken bulbs. In fact, large stub cavity 54 is positioned relative to large cup face 24 such that in combination, while large cup face 24 is in contact with the peripheral edge of a broken bulb base, large stub cavity 54 may be in contact and gripping the filament pedestal of the broken bulb.

Small tool 14 has some of the same primary functional features as corresponding components of large tool 12. Small base 28 serves essentially the same function as large stub 22, wherein small base face 32 may contact and grip a broken off bulb base in much the same way as large stub face 26. Likewise, small cup cavity 36 may surround and grip an unbroken or partially broken bulb in much the same manner as large cup cavity 20. Likewise too, small cup face 34 may serve to contact the peripheral edge of a broken off bulb base in much the same way as large cup face 24.

One secondary functional feature of small tool 14 is exhibited by a situation where small cup 30 might entirely fit into the base member of a broken bulb assembly, thereby allowing the lower surface of small base 28 to contact the peripheral edge of the base member.

Medium tool 16 duplicates many of the primary functional features of large tool 12 and small tool 14. Medium tool 16, however, provides four primary functional features rather than the three each disclosed above for tools 12 and 14. Each functional end of medium tool 16 contains both a surrounding/gripping cavity as well as a contacting/gripping face. First medium cup 38 has both first medium cup cavity 46, which may surround and grip an unbroken or slightly broken bulb of suitable size, as well as first medium cup face 42, which may contact and grip the peripheral edge of an appropriately sized base member of a broken light bulb.

In a similar fashion, second medium cup 40 has both second medium cup cavity 48, and second medium cup face 44 to either surround an appropriately sized unbroken or slightly broken bulb, and/or to contact and grip an appropriately sized base member of a broken light bulb.

The secondary functional features of medium tool 16 are also substantially similar to the secondary functional features of large tool 12 and small tool 14. Medium tool shoulder 58 may serve to contact and grip the peripheral edge of the base member of a broken light bulb in much the same fashion as large tool shoulder 66. Medium cup connector 62 may serve to surround the grip a glass or ceramic filament pedestal in much the same way large stub cavity 54 accomplishes with large tool 12.

All components of tool assembly 10 in the preferred embodiment are formed form a resilient rubber or synthetic rubber material. In the preferred embodiment, Shell Kraton G-77-20 type rubber, having a 60 Shore A durometer hardness rating, exhibits a consistency which will form a resilient structure, and provide a non-slip surface with which cavity surfaces and faces may grip. Each of the components are axially symmetrical, and may be easily molded by an injection process. The dimensions of each of the components of tool assembly 10 are defined by the dimensions of standard, frequently used light bulbs.

Large cup cavity 20 has an average internal diameter suitable to engage and grip light bulbs whose diameters are similar to #1057 (Sylvania) and #2057 (Sylvania) 12 volt auto bulbs. These bulbs include those typically used for parking lights, brake lights, turn signal lights, and clearance marker lighting in many automobiles and trucks.

First medium cup cavity 46 has an average diameter such that it will appropriately engage light bulbs having diameters similar to #1155 (Sylvania) 12 volt auto bulbs. Such bulbs are typically used for license place illumination lights, and for back up lighting.

Second medium cup cavity 48 has a diameter appropriate to engage a large number of smaller diameter bulbs typified by #1893 (Sylvania) 12 bolt auto bulbs, #53 (Sylvania), 12 volt auto bulbs, and #158 (Sylvania), 12 volt auto bulbs. These light bulbs are typically used for side marker and instrument lighting, and are frequently found in applications on electronic stereo components, and in other electrical devices where small illuminating lights are required.

Small cup cavity 36 has an average diameter appropriate to engage very small light bulbs or standard sized light emitting diodes. Typical bulbs that would define the diameter of small cup cavity 36 are 222 (Eveready) 2.25 volt "pen light" light bulbs, miniature christmas tree light bulbs, and standard sized neon "power-on" indicator light bulbs.

Large cup cavity 20 is also appropriate for a number of household light bulb applications. Many "candelabra" type light bulbs have varying cross sectional diameters, which may be appropriately engaged, when unbroken, by large cup cavity 20. The diameter of large cup cavity 20 is also appropriate to encompass the metallic base of an ordinary household incandescent light bulb.

Large cup face 24 is of a diameter appropriate for the outer edge engagement of a household light bulb base. Large cup face 24 may also be appropriate to engage the bases of larger, high voltage, gaseous arc discharge light bulbs.

Small cup face 34 is of a diameter that would suitably engage the exposed metal bases of many of the bulbs described above in association with second medium cup cavity 48. This is to be expected since, in their nested configuration, small cup face 34 is inserted into second medium cup cavity 48.

Second medium cup face 44 is of a diameter appropriate for the engagement of the #1057 and #2057 auto lamp bulbs and the like described above, and for the engagement of the base member of #1155 auto lamp bulbs described above.

First medium cup face 42 is of a diameter appropriate to engage the interior edge of the base of a broken standard incandescent household light bulb.

Large stub face 26 is of a diameter appropriate to engage the base members of broken bulbs of the type discussed above in association with second medium cup cavity 48, and second medium cup face 44.

In addition to the above described applications of the primary functional features of the three components of tool assembly 10, there are a number of additional secondary functional features that follow from the dimensions described above. Most notable among the secondary functional features is the capability of both large stub cavity 54, and medium cup connector 62 to appropriately engage the glass or ceramic filament support found in many household incandescent light bulbs.

One additional advantage provided by the material of which the three components are comprised is exhibited by the high frictional resistance provided when one tool surface contacts a second tool surface. Because of this frictional resistance, the various tool components may be placed or stacked adjacent to one another in a manner that extends the reach or increases the gripping power of the overall assembly.

Specific examples of this can be seen in the placement of medium tool 16 adjacent to large tool 12 in a manner that covers large stub 22 with first medium cup cavity 46. In this configuration, the reach provided extends the access of second medium cup face 44 and/or second medium cup cavity 48. In the same configuration, small tool 14 may be placed in position adjacent medium tool 16, wherein small cup 30 is inserted into second medium cup cavity 48. This allows the use of small base face 32 in an extended position atop medium tool 16 and large tool 12.

Another example of such stacking can be seen by the placement of small base 28 within first medium cup cavity 46. This configuration not only extends the reach of small cup cavity 36 and small cup face 34, but increases the gripping ability around small base 28 in turning the tool assembly.

Although the preferred embodiment of the present invention has been described in detail, its detailed description should not be construed as limiting its scope, but merely providing illustrations of some of the presently preferred embodiments of this invention. For example, primary components of the present invention could be formed of many flexible resilient materials other than rubber, and may have durometer hardness rating that vary significantly from the preferred embodiment. Further, the present invention can be applied to light bulbs of sizes significantly larger or smaller than those specifically described herein. The three primary components of the present invention may be used to extract light bulbs that are difficult to handle for reasons not described herein. Thus, the scope of the present invention should be determined by the appended claims rather than by these specific examples described.

We claim:

1. An apparatus for extracting and handling a light bulb, comprising:

a substantially cylindrical cup having first and second ends, said first end defining an opening into a cavity that extends into an interior of said cylindrical cup, and said second end defining a closure to said cavity of said cylindrical cup;

a stub, integrally attached to said second end of said cylindrical cup, said stub having a diameter less than said cylindrical cup, said stub extending away from said second end of said cylindrical cup, said stub having a substantially flat surface disposed on an end thereof positioned away from said second end of said cylindrical cup;

a second substantially cylindrical cup having first and second ends, said first end defining an opening into a cavity that extends into an interior of said second cylindrical cup, and said second end defining at least a partial closure to said cavity of said second cylindrical cup; and a third substantially cylindrical cup integrally attached to said second end of said second cylindrical cup, said third cylindrical cup having a diameter less than that of said second cylindrical cup and having a first end and a second end, said first end defining an opening that extends into an interior of said third cylindrical cup, said second end being attached to said second cylindrical cup;

wherein said second cylindrical cup and said third cylindrical cup are sized so as to be inserted into said cavity of said fist cylindrical cup, and wherein said first cylindrical cup, said stub, said second cylindrical cup, and said third cylindrical cup are formed of a flexible, elastic material such that said first and second cylindrical cups may be sued us surround and grip said light bulb, said third cylindrical cup may be used to surround and grip said light bulb and to contact and grip a broken base of said light bulb, and said stub may be used to contact and grip a broken base of said light bulb.

2. The apparatus of claim 2 further comprising:

a substantially disc-shaped cap having a first end and a second end and having a diameter less than that of said cavity of said first cylindrical cup, said cap having a substantially flat surface disposed on said first end thereof; and a fourth substantially cylindrical cup integrally attached to said second end of said disc-shaped cap, said fourth cylindrical cup having a diameter less than that of said third cylindrical cup, and having a first end and a second end, said first end defining an opening that extends into an interior of said fourth cylindrical cup, said second end being attached to said disc-shaped cap;

wherein said disc-shaped cap and said fourth cylindrical cup are sized so as to be inserted into said interior of said third cylindrical cup, and wherein said second disc-shaped cap and said fourth cylindrical cup are formed of a flexible, elastic material such that said fourth cylindrical cup may be used to surround and grip said light bulb and to contact and grip a broken base of said light bulb, and said disc-shaped cap may be used to contact and grip a broken base of said light bulb.

3. The apparatus of claim 1 wherein said cavity of said second cylindrical cup is connected to said cavity of said third cylindrical cup by a cylindrical tunnel, said cylindrical tunnel having a diameter less than that of said second cylindrical cup, and less than that of said third cylindrical cup.

* * * * *